United States Patent [19]

Hutton

[11] Patent Number: 4,972,534

[45] Date of Patent: Nov. 27, 1990

[54] FLOTATION COVER FOR MATTRESSES

[76] Inventor: Deanice B. Hutton, 58481 Ross Rd., Warren, Oreg. 97053

[21] Appl. No.: 446,045

[22] Filed: Dec. 5, 1989

[51] Int. Cl.[5] ..... A47C 27/08; A47G 9/00

[52] U.S. Cl. ..... 5/450; 5/451; 5/502

[58] Field of Search ..... 5/451, 452, 450, 482, 5/500, 502, 449, 470

[56] References Cited

U.S. PATENT DOCUMENTS

| | | | |
|---|---|---|---|
| 3,576,039 | 4/1971 | Roberts | 5/484 |
| 3,702,484 | 11/1972 | Tobinick et al. | 5/451 |
| 3,958,286 | 5/1976 | Rodinsky | 5/451 |
| 4,062,077 | 12/1977 | Autrey et al. | 5/451 |
| 4,187,566 | 2/1980 | Peterson | 5/451 |
| 4,213,214 | 7/1980 | Gilhooly | 5/451 |
| 4,317,244 | 3/1982 | Balfour-Richie | 5/500 |
| 4,424,600 | 1/1984 | Callaway | 5/500 |
| 4,611,357 | 9/1986 | Chelin | 5/451 |
| 4,672,701 | 6/1987 | Kocsis | 5/451 |

OTHER PUBLICATIONS

"ARDO", an ad from Time Products section of the Jul. 1983 issue of Flotation Sleep Industry.

"At Ease®", an ad from p. 23 of the 12/85 issue of Waterbed magazine.

*Primary Examiner*—Alexander Grosz

*Attorney, Agent, or Firm*—Chernoff, Vilhauer, McClung & Stenzel

[57] ABSTRACT

A mattress cover for use on a conventional innerspring mattress to give the same feeling as is provided by a waterbed, including a liquid-filled flat bladder having a small height from its top wall to its bottom wall. Insulative padding is included in a casing and held in position atop the bladder to reduce loss of a user's body heat to the liquid, and to provide support. The floating sensation imparted by the flotation cover is facilitated by a wall construction being of sufficient thickness to contain the water within a substantially fixed volume. Fibrous material may be arranged within the bladder to damp wave action of the liquid to a limited degree. A liner surroundingly encloses the lower parts of the bladder within the fabric casing to contain liquid leakage.

6 Claims, 2 Drawing Sheets

FLOTATION COVER FOR MATTRESSES

BACKGROUND OF THE INVENTION

The present invention relates to mattresses for beds. In particular, the invention relates to liquid-filled pads that substitute for conventional waterbed mattresses.

A unique attribute of a waterbed mattress is the floating sensation experienced by a user reclining on the mattress. This comfortable floating feeling, and the way in which the surface yields and conforms to the user's body, have contributed greatly to the commercial success enjoyed by waterbed mattresses. There are, however, certain disadvantages with ordinary waterbed mattresses that have limited their use and enjoyment.

One such disadvantage, occurring because of the compliance of the waterbed, is the possibility of excessive flexure of the user's spinal column into the waterbed mattress as the person lies on the mattress. Another disadvantage is the wearisome duration of wave motion of the water, that begins upon rapid movement by the reclining occupant and may continue for an extended time afterward.

A further disadvantage of existing waterbed mattresses is their inability to support concentrated pressure, resulting in a tendency to be depressed in the places where a person pushes upon the mattress to rise away from it. This can be particularly troublesome to persons who are restricted in the movement of their limbs.

Other disadvantages result from the large quantity of water utilized in a waterbed mattress. For example, the heavy weight of the filled mattress may overstress the structure of older buildings and makes transport of a filled waterbed mattress impractical even for short distances within a room. Additionally, the large body of contained water must be kept heated on a continual basis to avoid uncomfortable chilliness as the water absorbs heat from the user's body. Furthermore, there is an ever present danger of water leakage and consequent damage.

To address these problems, one approach used has been to use a waterbed mattress containing less water. It has been found, however, that a reduction in waterbed mattress height below four inches causes an undesirable "bottoming out" effect. The volume of water displaced when the user suddenly shifts position or sits up may be great enough that a portion of the occupant's body collides with the board or other rigid material used to support the underside of the waterbed mattress.

As disclosed by Rodinsky, U.S. Pat. No. 3,958,286, a pad for use atop a conventional mattress to extinguish fires and to provide desired support characteristics comprises a bladder having opposite upper and lower sheets interconnected with each other to define a number of individual, but internally interconnected, water compartments. Such pads, however, are not intended for nor apparently capable of providing the floating sensation that provides a waterbed with its unique character and advantages.

What is desired, then, is an improved bedding structure that provides the sensation of floating provided by a waterbed mattress, in conjunction with the firmness and the handling convenience of an innerspring mattress, while avoiding the disadvantages of previously available waterbed mattresses.

SUMMARY OF THE INVENTION

The present invention provides a bed having the comfort and feel of a waterbed and overcomes the aforementioned shortcomings of previously available waterbed mattresses, by providing a novel flotation cover for use on a conventional mattress. The flotation mattress cover of the present invention comprises a flexible liquid-filled bladder of much smaller height than an ordinary waterbed mattress. In a preferred embodiment the height between the top and bottom members of the bladder is at least 1 inch while not exceeding 2 inches. With a smaller bladder height the desired floating sensation may not be experienced by a heavy person reclining on the mattress cover of the invention. Because the cover is intended for use on a conventional mattress such as an innerspring mattress, if a person sits or presses on the flotation cover in a way that pushes the top member of the bladder down into contact with the bottom, the support and cushioning of the conventional mattress is available rather than the hard support board underlying conventional waterbeds.

To reduce loss of body heat to the water contained within the bladder, and to provide firmness at the top surface of the bladder, a preferred embodiment of the invention includes an insulative layer of padding atop the bladder.

Another aspect of the present invention is a recognition that the desirable floating sensation results in part from a certain amount of wave action or displacement of part of the liquid contained in the bladder. This is made possible by use of an undivided bladder containing the liquid which provides support. Instead of relying on compartmentation or internal baffles that resist bladder distortion but entirely damp the wave action within the bladder, the bladder is filled with only a shallow layer of liquid of insufficient amount to sustain wave action for an unpleasantly long time. However, a preferred embodiment of the present invention does seek to further shorten the duration of wave movement somewhat while not eliminating it completely. To achieve the desired amount of damping, a preferred embodiment of the invention includes a layer of loose fibrous material inside the bladder to resist wave movement of the liquid. The construction of the bladder being of sufficiently flexible sheet material also allows partial absorption of the waves, providing a system in which waves are adequately damped for comfort.

A liner of plastic film material surrounding part of the bladder is preferably provided to temporarily contain any leakage from the bladder itself.

It is therefore a principal object of the present invention to provide a bedding structure having the desirable features of both waterbeds and conventional mattresses.

Another object of the present invention is an improved bedding structure of relatively light weight having the comfort and feel of an ordinary waterbed mattress.

Yet a further object of the present invention is to provide an improved bedding structure wherein a liquid-filled bladder of relatively small height provides the comfort and floating sensation associated with an ordinary waterbed mattress, but without spinal discomfort, sinking, or bottoming out.

A feature of the flotation cover of the present invention is that it is light enough in weight to be portable conveniently even when filled.

An advantage of the flotation mattress cover of the present invention is that it provides the sensation associated with an ordinary waterbed mattress without the need for the great weight of previously available waterbeds.

Another advantage of the flotation mattress cover of the present invention is that it provides the floating sensation of an ordinary waterbed mattress without requiring artificial heating to avoid uncomfortable chilliness.

DETAILED DESCRIPTION OF THE INVENTION

Figure 1:
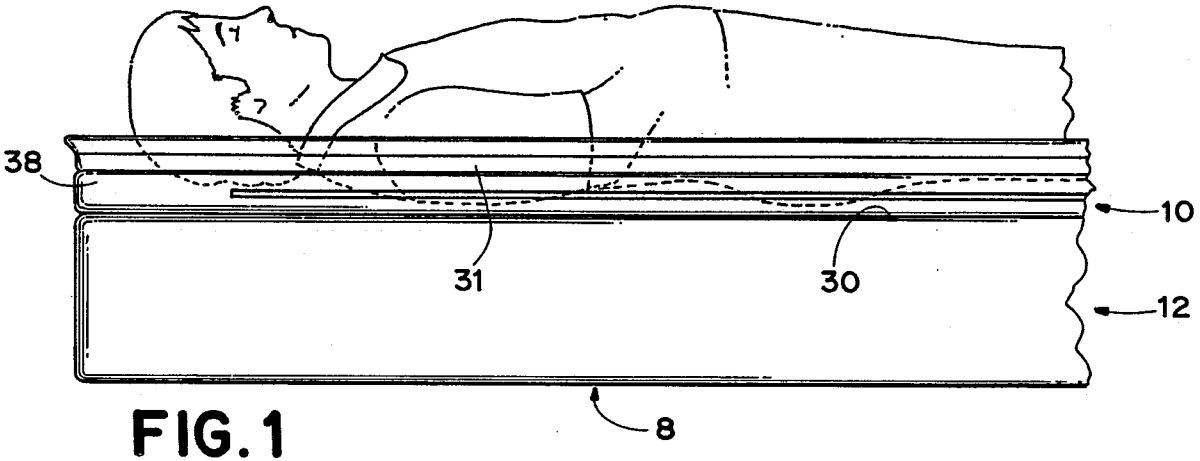
FIG. 1 is a side view of an exemplary liquid-filled flotation cover embodying the present invention, situated on a conventional mattress and supporting a reclining occupant.
Figure 2:
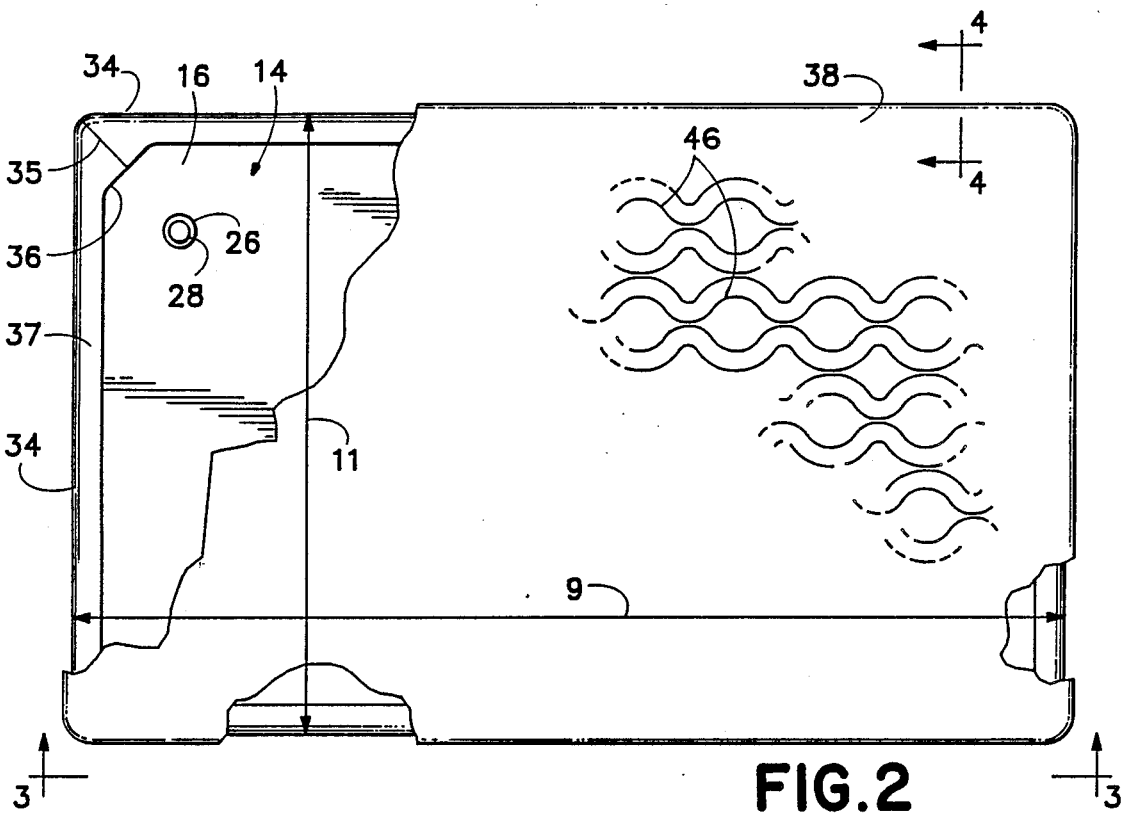
FIG. 2 is a top plan view, at a reduced scale, of the mattress and flotation cover of FIG. 1, shown partially cut away to reveal additional features of the flotation cover.
Figure 4:
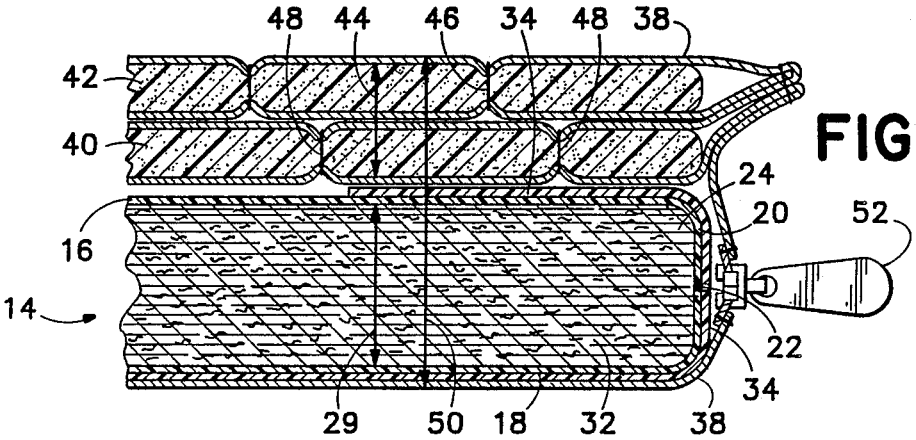
FIG. 4 is a sectional view of a portion of the flotation cover shown in FIG. 2, taken along line 4—4, at an enlarged scale.

Referring now to the drawings which form a part of the present disclosure, FIG. 1 shows a bed 8 having an exemplary flotation cover 10 resting atop a conventional innerspring mattress 12 with an occupant in reclining position on the flotation cover 10. Referring also to FIGS. 2 and 4, the flotation cover 10 comprises a flexible watertight bladder 14, having a top wall 16, a bottom wall 18, and side walls 20. The side walls 20 may be formed by a thermal butt weld 22 (FIG. 4) between marginal portions of top wall 16 and bottom wall 18, or by another conventional fabrication process. The top and bottom walls 16 and 18 are of a length 9 and width 11 substantially coextensive with the length and width of the conventional innerspring mattress 12 (FIG. 2). The bladder 14 is filled with water 24 (FIG. 4) or another suitable liquid to provide floating support, yet the flotation cover 10 remains light enough to be moved fairly conveniently while positioned either on or off the mattress. As contrasted with conventional waterbed mattresses, the weight of the contained volume of water 24 is not sufficient to overstress the framework of older buildings. However, the flotation cover 10 is heavy enough to remain on the mattress 12 without slipping out of place and without a need for separate fastenings.

In a preferred embodiment, the respective walls of the bladder 14 are fabricated of vinyl plastic film thick enough to result in the bladder being substantially inelastic. With this material, for example, the bladder walls 16, 18 and 20 should each have a thickness of at least 15 mils.

Referring to FIG. 2, an inlet tube 26 communicates with the interior of the bladder 14 for filling it with water. A cap 28 is provided as a closure for the inlet tube 26, and may be threaded for secure sealing engagement with the inlet tube 26.

Referring to FIGS. 1 and 4, with the flotation cover 10 atop the mattress 12, when the bladder 14 has been filled with a suitable liquid, such as water, the top wall 16 of the bladder is supported by the contained liquid, providing a flexible movable surface upon which a person may rest. The effect achieved is to provide the sensation of floating similar to that which is felt while floating in an open body of calm water. One factor contributing to this effect is the controlled height 29 of the bladder 14 defined between its top wall 16 and its bottom wall 18 (FIG. 4). Preferably, the height 29 is at least 1 inch but not exceeding 2 inches, and is established by the shape of the bladder 14 and, in particular, by the height of the vertical or side walls 20. This provides a sufficient depth of water within the bladder 14 to create the desired floating sensation. At the same time, the top 30 of the mattress 12 prevents the heavier bodily parts of the occupant, such as the chest region 31, from sinking too deeply into the flotation cover 10 relative to other portions of the person (FIG. 1). This avoids the excessive flexure of the spine that can occur in conventional waterbed mattresses.

Because the flotation cover 10 is supported by the innerspring mattress 12, no discomfort results from displacement of the liquid to the full depth of the bladder 14. A large and sudden exertion of downward pressure on the flotation cover 10, such as when the user suddenly sits up, may at worst bring the user indirectly into contact with the padding of the mattress 12, rather than with a hard supporting board as is used beneath conventional waterbed mattresses. As suggested by FIG. 1 there may be some portions of the top wall 16 and bottom wall 18 forced into mutual contact by displacement of the liquid 24, where the weight of a person is most concentrated, as in the chest region 31, so that such portion of the person is supported more nearly directly atop mattress 12, depending on the concentration of weight, the volume of liquid, and the elasticity of the bladder walls. However, provided there is sufficient buoyancy for the remainder of the person, a small portion supported directly by the mattress 12 does not significantly reduce the floating sensation imparted to the occupant.

Another factor contributing to the desired free-floating sensation provided by the flotation cover according to the invention is the controlled thickness of the flexible material forming the bladder 14. When the preferred bladder material, vinyl plastic film, is used, the thickness of the top wall 16, the bottom wall 18, and the side walls 20 should be at least 15 mils. Referring to FIG. 4, if the thickness of the respective walls of the bladder 14 were made much smaller than 15 mils there would be a tendency for the bladder 14 to swell or balloon up when the bladder 14 was filled with water at all beyond its properly filled state, or in response to increased pressure resulting from a person's weight carried on part of the bladder 14. That is, the walls, if thinner, would be too elastic to contain the water satisfactorily within a substantially fixed volume having the desired rectangular form depicted. Although such ballooning could be controlled by using an extensive network of internal webs or the like between the top wall 16 and bottom wall 18, or by using an extensive network of seams directly interconnecting the top and bottom walls, such methods would be costly and detrimental to the floating sensation that gives waterbed mattresses their unique advantage. Some interconnection is not inconsistent with the present invention, but the amount of interconnection should only damp the duration of the wave motion rather than eliminate it entirely. On the other hand, the walls of the bladder are preferably of plastic film no thicker than 50 mils, so that wave energy encountering the respective walls is partially dissipated in moving the walls, and so that the bladder is comfortably flexible.

Again referring to FIG. 4, it has been found that effective damping of the wave motion may be accomplished by arranging a loosely packed fibrous material 32, such as long, loosely matted, fine polyester filaments within the bladder 14. Proper arrangement of the fibrous material 32 will resist wave motion of the water within the bladder 14 enough to damp out large waves quickly, yet leave enough wave motion to preserve the floating sensation desired of a waterbed.

To protect against possible water leakage and resultant damage to items in the vicinity of the flotation cover 10, a flexible liner 34 partially surrounds the bladder 14, preferably being fitted to the bottom wall 18, side walls 20 and peripheral edges of the top wall 16 as depicted in FIGS. 2 and 4. The liner 34 may be made by welding together the edges of a single sheet of plastic film material to form corner seams 35, as shown in FIG. 2, with each corner extending diagonally over a corner portion of the upper member 18 of the bladder 14, as shown at 36. A marginal portion 37 of the liner 34 extends along each side edge and end edge of the upper member 18 of the bladder 14, while the central portion of the sheet covers the entire bottom of the bladder 14. The liner 34 thus retains itself beneath and around the margins of the bladder 14. If a hole then develops in the bladder 14, the liner 34 will contain all or most of the leakage until the bladder 14 can be emptied for repair or replacement. Preferably, the flexible liner 34 is made of vinyl plastic film having a thickness within the range of 2 to 7 mils.

Figure 3:
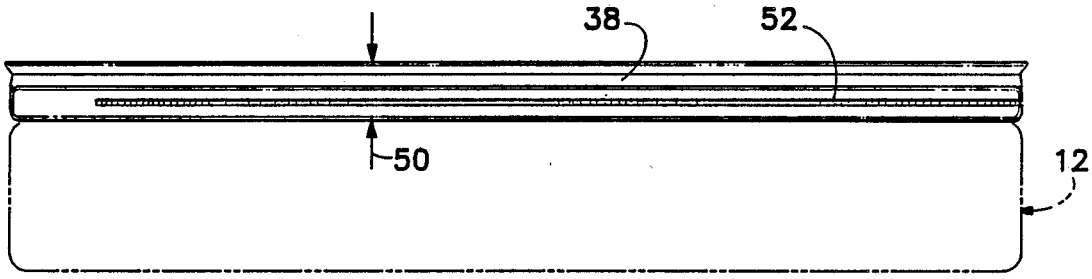
FIG. 3 is a side view of the mattress and flotation cover shown in FIGS. 1 and 2, taken along line 3—3 of FIG. 2.

Referring to FIGS. 3 and 4, the bladder 14 is enclosed by a casing 38 of suitably strong cloth such as mattress ticking. The casing 38 contains and protectively covers an insulative and supportive upper layer of padding, preferably of high density polyurethane foam, including an inner layer 40 and outer layer 42 which are quilted together with the top fabric of the casing 38. The layers 40 and 42 of padding, preferably having a combined thickness 44 in the range of $\frac{3}{4}$ inch to 1 inch, serve to capture small pockets of stationary air, thereby insulating the bladder 14 and eliminating the need to heat the water inside the bladder. The quilting stitches 46 and 48 extend through the padding and prevent the respective layers 40 and 42 from bunching up on each other and keep them properly positioned on the bladder 14. The layers 40 and 42 provide vertical support for a person resting on the bed 8, while they are flexible enough to permit enough movement to provide a floating sensation. The padding also spreads the area of application of pressure on the top of the flotation cover 10 somewhat, improving the ability to support a person and still provide flotation. The combined assembly of the filled bladder 14, the layers of padding 40, 42 and the casing 38 provide a flotation cover 10 having an overall thickness 50 in the range of $1\frac{3}{4}$ to 3 inches.

The fabric casing 38 includes a closure, such as a slide fastener 52, for selectively opening the fabric casing 38 to receive the bladder 14. Instead of a slide fastener 52, closure may be effected by hook-and-portion loop fasteners such as the material well known by the trademark VELCRO, or by snap fasteners (not shown).

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A flotation cover for use atop a conventional mattress, said cover being adapted to be substantially coextensive with the top surface of said conventional mattress comprising:

(a) flotation means, including a substantially inelastic flexible bladder substantially filled by a shallow body of a liquid with a depth no greater than about two inches, for imparting a sensation of floating to a user reclining on said flotation cover;

(b) a layer of thermally insulative cushioning material not thicker than about one inch; and (c) flexible casing means comprising a top layer, a bottom layer, and a side member connecting said top layer to said bottom layer, said casing means enclosing said bladder and retaining said layer of insulative cushioning material atop said bladder in a generally flat configuration when said flotation cover is in place atop said mattress, the side member of the casing including an opening and a separable fastener means adapted to close said opening the opening being of a sufficient size to permit the insertion and removal of said bladder, said thermally insulative cushioning material being substantially coextensive with said bladder and comprising a plurality of layers fixedly attached to the top layer of the casing.

2. The flotation cover of claim 1 wherein said depth of said body of a liquid is in the range of 1 inch to 2 inches.

3. The flotation cover of claim 1 wherein said bladder includes a top member, a bottom member, and a side member sealingly interconnecting the peripheries of said top and bottom members, all of said top, bottom and side members being of flexible film material.

4. The flotation cover of claim 3 wherein said top member and bottom member are interconnected with each other only through said side member.

5. The flotation cover of claim 1, said bladder including a layer of loosely packed fibrous material contained therein for damping wave movement of said liquid within said bladder.

6. The flotation cover of claim 1, wherein said layer of thermally insulative cushioning material is not substantially thicker than said depth of said shallow body of liquid.

* * * * *

UNITED STATES PATENT AND TRADEMARK OFFICE

CERTIFICATE OF CORRECTION

PATENT NO. : 4,972,534

DATED : November 27, 1990

INVENTOR(S) : Deanice B. Hutton

It is certified that error appears in the above-identified patent and that said Letters Patent is hereby corrected as shown below:

Col. 6, line 17 After "mattress" insert --,--;

line 33 After "opening" insert --,--.

Signed and Sealed this

Fifteenth Day of September, 1992

*Attest:*

DOUGLAS B. COMER

*Attesting Officer*

*Acting Commissioner of Patents and Trademarks*